United States Patent [19]

Wolf

[11] Patent Number: 4,592,196

[45] Date of Patent: Jun. 3, 1986

[54] CAP OR BELL SPINNING MACHINE

[75] Inventor: Horst Wolf, Albershausen, Fed. Rep. of Germany

[73] Assignee: Zinser Textilmaschinen GmbH, Ebersbach, Fed. Rep. of Germany

[21] Appl. No.: 688,933

[22] Filed: Jan. 4, 1985

[30] Foreign Application Priority Data

Jan. 7, 1984 [DE] Fed. Rep. of Germany ..... 3400327

[51] Int. Cl.[4] ..... D01H 7/66

[52] U.S. Cl. ..... 57/74; 57/67

[58] Field of Search ..... 57/67, 68, 70, 71–74

[56] References Cited

U.S. PATENT DOCUMENTS

| | | | |
|---|---|---|---|
| 959,198 | 5/1910 | Boyd | 57/74 X |
| 1,969,685 | 8/1934 | Bird | 57/74 |
| 2,041,918 | 5/1936 | Freund | 57/74 |
| 2,548,610 | 4/1951 | Lambert | 57/67 |
| 3,623,313 | 11/1971 | Bucher et al. | 57/74 X |
| 4,437,300 | 3/1984 | Vignon | 57/74 |

*Primary Examiner*—John Petrakes

*Attorney, Agent, or Firm*—Karl F. Ross; Herbert Dubno

[57] ABSTRACT

A cap spinning machine includes a spindle which supports a spool and a cap covering the spindle and the spool. The cap is supported in a freely rotatable manner and is brought into a rotating motion by the spindle via a thread which is guided around the outer surface of the cap to the spool. Consequently, the rotational speed of the cap is automatically controlled depending on the lagging of the cap behind the rotation of the spindle. By means of a driving and/or braking device, the driving force of the cap transmitted by the spindle via the thread is additionally controllable so that the tensile force of the thread and thus the closeness of the formed winding is influenced as well.

18 Claims, 4 Drawing Figures

CAP OR BELL SPINNING MACHINE

FIELD OF THE INVENTION

My present invention relates to a cap or bell spinning or twisting machine.

BACKGROUND OF THE INVENTION

Known cap spinning machines include a driven spindle carrying a spool and a cap or bell which surrounds the spindle and the spool. A thread to be coiled round the spool is guided along the lower edge of the cap and led from the outside to the inside of the spool.

These cap spinning machines have, however, the disadvantage that during the spinning process a thread balloon is formed around the cap. Due to its air resistance and the centripetal force acting thereon, this thread balloon limits the spinning velocity.

OBJECT OF THE INVENTION

It is thus the principal object of my invention to provide an improved cap or bell spinning or twisting machine obviating the afore-stated drawbacks.

SUMMARY OF THE INVENTION

I realize this object according to the invention by providing a spindle which carries a spool and a cap or bell covering the spindle and the spool and being supported in a freely rotatable manner. The cap is brought into a rotational motion by the thread wound around the cap by means of a thread guide and transferred to the spool which is rotated by the spindle. The thread guide is arranged in the axis of the rotation of the cap so as to direct the thread around the cap.

Consequently, the thread is wound in a helical manner around the cap and drags along the cap without formation of a thread balloon so that the spinning velocity is increased and the spinning result is improved. Since the cap lags the spindle by only the extent necessary for winding the thread onto the spool, the thread slides over the outer face of the cap only with its feeding speed.

For guaranteeing a prevention of the thread balloon formation, I have found to be advantageous to provide the cap as slim as possible. It is especially preferred to provide a thin-walled cap whose contour is adapted to the contour of the spool and the winding cone of the cop or bobbin winding. Thus the cap is provided with an essentially cylindrical shank and a conical foot both of which are arranged at a distance to the spool and the thread winding so as to allow passage of the thread therebetween.

According to a first embodiment of the invention, the thread guide is arranged at the upper end of the cap and includes a thread deflector provided in one piece with the cap. The thread deflector is accommodated in a shaft which is provided in elongation of the cap and is supported together with the cap in a freely rotatable manner in a bearing. Therefore, due to the flying bearing of the shaft, a low working range is obtained, and the provision of a hollow spindle is not required. Extending through the shaft is a channel which has an entrance opening in the axis of rotation of the cap and in vicinity i.e. at the upper end of the cap has an outlet opening. By this channel arrangement which constitutes the thread deflector, the thread is guided therethrough and coiled around the cap.

According to a further embodiment of my invention, the thread guide is formed to prevent generation of a thread balloon. Accordingly, the thread guide is provided with a spinning crown or spinning finger each of which is closely arranged below a thread guide eyelet.

In both embodiments, the thread is wound in a helical manner around the cap towards its lower edge at a pitch angle and looping angle which is adjusted to the given circumstances, i.e. to the changing diameter of the thread winding formed on the spool.

For accelerating the cap from the rest position to the operating speed without any excess overstrain to the thread which transmits the acceleration to the cap, the shaft is connected to a driving unit. In addition, the shaft can be connected to a braking unit so as to abruptly decelerate the cap or bell to the rest position when the cap spinning machine is switched off and to prevent a leading of the cap relative to the spindle.

According to a further feature of the invention, the cap and/or the spool can be surrounded by jackets for reducing air friction losses. The jackets can be separated from each other or be arranged in one piece; however, in order to allow access to the cap spinning machine are either provided so as to be easily removable or preferably openable up via respective hinges.

BRIEF DESCRIPTION OF THE DRAWING

The above and other features of my invention will now be described in detail with reference to the accompanying drawing in which.

SPECIFIC DESCRIPTION

In the following description all references to a cap or bell spinning machine will be understood to be applicable to a cap or bell twisting machine as well.

Figure 1:
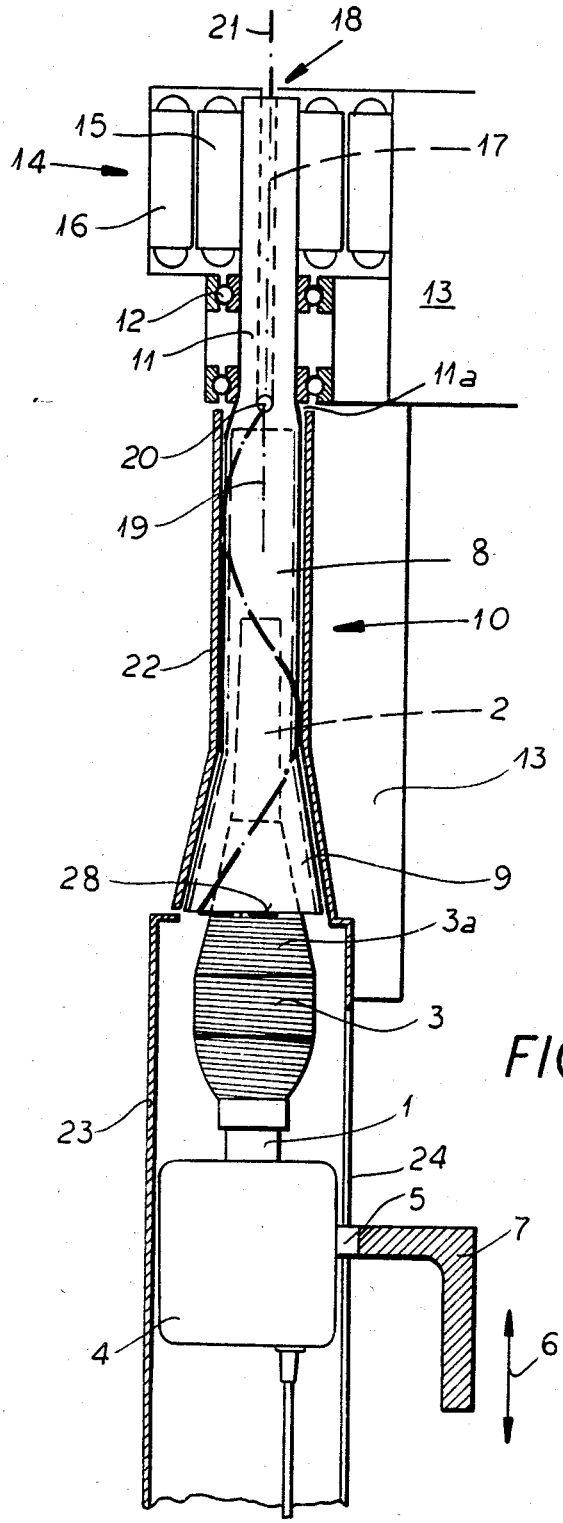
FIG. 1 is a partly sectional view of a first embodiment of a cap spinning machine according to the invention.

Referring firstly to FIG. 1, I have shown a cap spinning machine including a spindle 1 to which a replaceable conical sleeve or tube 2 is attached. The bobbin or cop 3 wound on this spool has a cone portion 3*a* in the process of bobbin or spool building. At its lower end portion, the spindle 1 is connected to a spindle motor 4 so that the spindle 1 acts also as a rotor shaft thereof. The spindle motor 4 is connected via a supporting arm 5 to a spindle rail 7 which is common to all of the cap spinning units of the spinning frame and moves upwardly and downwardly in a direction of double-headed arrow 6 relative to the axially fixed bell or cap for providing the cop winding in a manner known per se.

Surrounding the tube 2 and at least partly surrounding the cone poriton 3*a* and thus the thread winding is a slender and thin-walled cap or bell 10 which includes an essentially cylindrical shank 8 and a conical foot 9 connected to the latter. The shank 8 extends beyond the tube 2 and is integrally connected with its upper portion to a hollow shaft 11 which has a smaller diameter than the shank 8 so that a conical junction 11*a* is obtained. The shaft 11 is supported in a bearing 12 such that the cap 10 is freely rotatable about an axis of rotation 19.

The bearing 12 is attached to frame 13 of the cap spinning machine.

Further connected to the shaft 11 is a device 14 for driving and/or braking the cap 10. In the illustrated embodiment, the driving and/or braking device 14 is constituted by an electromotor whose rotor 15 is arranged on the shaft 11 while its stator 16 is attached to the frame 13. Driving and braking of the cap by such an electromotor is known per se. In case, only braking of the cap should be provided, the device 14 can be designed in a different manner e.g. as a magnetic brake.

Cooperating with the cap 10 for guiding the thread 21 is a thread deflector which is formed by a longitudinal channel 17 accommodated within the shaft 11 and extending coaxially to the shaft 11. The channel 17 has an upper entrance opening 18 which is arranged in the axis of rotation 19 of the cap 10. The lower outlet opening 20 of the channel 17 is located below the bearing 12 at the junction 11*a* and thus above the upper end of the shank 8. The shaft 11 communicates with a drawing device or a delivery device (not shown) which supply a thread 21 in form of a yarn or twist of two or more yarns to the entrance opening 18.

As can be seen from FIG. 1, the cap 10 is surrounded by a stationary jacket 22 which follows the contour of the cap 10. The jacket 22 is arranged to the cap 10 at a distance sufficient to allow the thread 21 to be coiled around the shank 8 and the foot 9 and is connected to a further jacket 23 which surrounds the part of the spool 3 projecting from the cap 10 as well as the spindle 1 and the electromotor 14. In order to accommodate the electromotor 4 in its interior, the jacket 23 has a larger width than the jacket 22 and is provided with a lateral slot 24 through which the supporting arm 5 projects and along which the supporting arm 5 can be guided to move the electromotor 4 upwardly and downwardly within the interior of the jacket 23.

In order to permit removal of a finished cop or to correct a thread breakage and thus to make the interior of the jackets 22 and 23 accessible from the outside, the jackets 22, 23 are each divided along their longitudinal extension so as to define a rear portion which is fixedly connected to the machine frame 13 and a front portion articulated to the rear portion via a hinge 25 or 25*a*, respectively. The front portion of each jacket 22, 23 is further provided with a holding plate 26 and 27, respectively to facilitate opening up of the jackets 22, 23. I may note that it is certainly conceivable to provide the front portions of the jackets 22, 23 in one piece and thus to allow simultaneous opening thereof.

After having described the individual parts of this embodiment, the mode of operation will now be described.

The thread 21 is guided from the drawing device or delivery device to the entrance opening 18 and travels through the channel 17. After leaving the channel 17 through the outlet opening 20, the thread 21 moves in a helical manner around the shank 8 and the foot 9 of the cap 10 until it reaches the lower edge 28 from where the thread 21 is transferred and coiled round the conical portion of the thread winding or spool 3 which is brought into a rotational motion by the spindle 1. At the beginning of the run of the spindle 1, the cap 10 is still in its rest position so that the thread 21 is coiled round the cap 10 at a small pitch angle and at a high number of windings. That means the farther the rotation of the cap 10 lags behind the rotation of the spindle 1, the smaller is the pitch angle and the higher is the number of windings around the cap 10. Consequently, a large number of windings of the thread round the cap 10 constitutes a large looping angle by which according to the principle of rope friction the required motive energy to accelerate the cap 10 is provided until the latter reaches or slightly exceeds the rotational speed of the spindle 1.

In case the rotation of the cap 10 exceeds the rotation of the spindle 1, the winding number decreases thereby reducing or completely stopping the transfer of motive energy so that the rotational speed of the cap 10 decreases as well. When, however, the reduction is such that the speed of the cap 10 lags behind the speed of the spindle 1, the number of windings will be increased so that a stable state is obtained very rapidly in which the cap 10 lags behind the spindle to an extent necessary for winding the thread 21 around the changing winding diameters.

The entire energy for accelerating the cap 10 to the operational speed is thus transmitted by the thread 21 during the start of the machine. In case, however, thin threads are used which have a limited tensile stress and thus might be overstrained, or when it is requested to accelerate the cap 10 within a certain period, the electromotor 14 can be used to drive the cap 10 during start of the spinning machine.

In general, I may note that the closeness of the thread winding is determined by the tensile force of the portion of the thread located between the lower edge 28 of the cap 10 and the take-up point onto the thread winding of the spool 3. This tensile force depends on the motive energy transmitted by the thread 21 onto the cap 10. Since the cap 10 runs very easily, the energy to be transmitted can be so low that the required tensile force is not sufficient to provide a thread winding of necessary closeness. Consequently, in order to obtain the required tensile force, the braking device 14 can be provided to continuously brake the cap 10 in an adjustable manner even during normal operation. Thus, through the provision of the driving and/or braking device 14, the tension of the thread between the lower edge 28 of the cap 10 and the take-up point onto the spool 3 and hence the closeness of the cop winding is controllable.

In case, very fine threads are used which have hardly any tensile strength, it is advantageous to provide a base load power for driving the cap 10 also during normal operation by the electromotor 14 which thus continuously runs, and to adjust the speed of the cap 10 to the speed of the spindle 1 for winding the thread 21 by means of the coiling of the thread round the cap 10. The braking device 14 is further necessary to abruptly decelerate the rotation of the cap 10 when the spinning machine is turned off in order to prevent a leading of the cap 10 with respect to the spindle 1 which would result in a thread breakage.

When a finished winding cop is provided and the spinning machine is turned off, the front portion of each jacket 22, 23 can be opened up by pulling the holding plate and the cop can be removed.

Figures 2, 4:
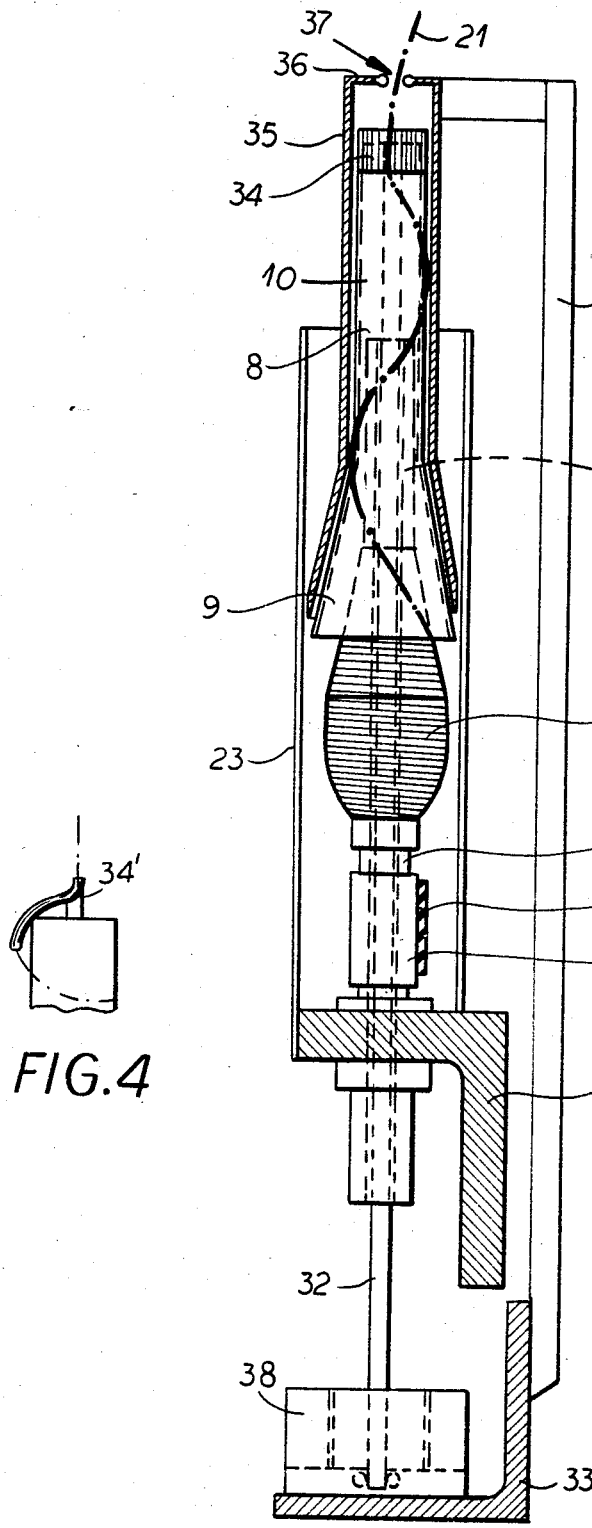
FIG. 2 is a partly sectional view of a second embodiment of a cap spinning machine according to the invention.
FIG. 4 shows a modification of a portion of FIG. 2.
Figure 3:
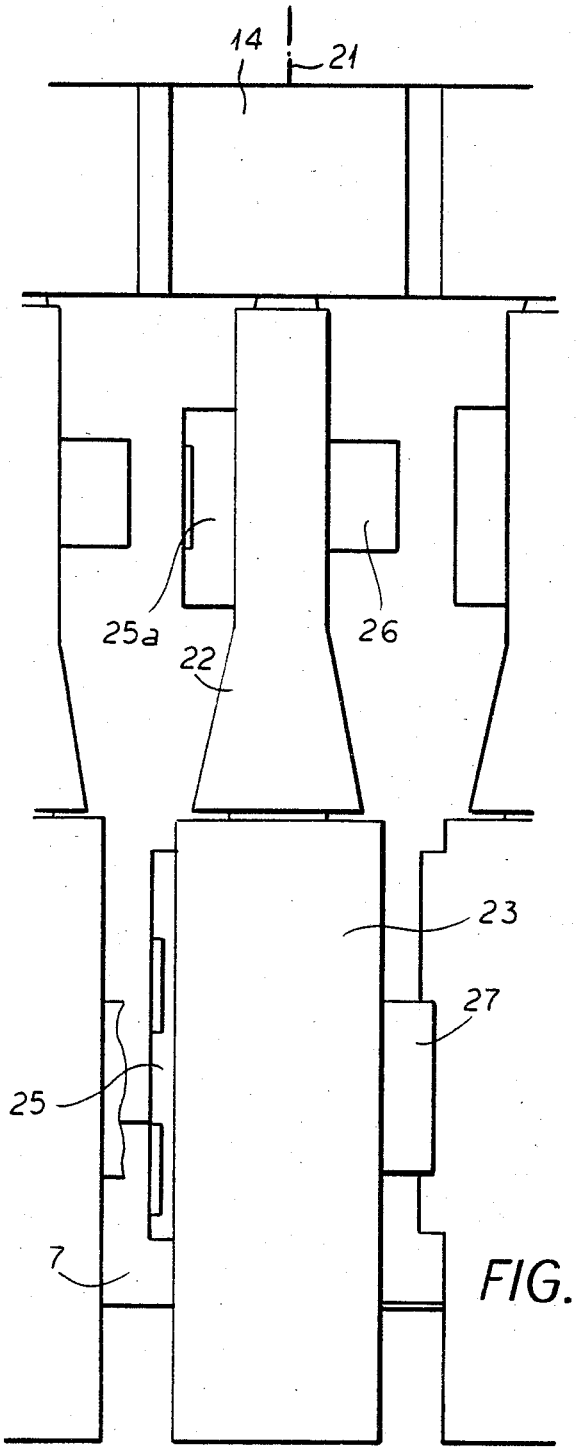
FIG. 3 is an elevational view of the cap spinning machine of FIG. 1.

Turning now to FIG. 2, there is shown a second embodiment according to the invention in which a hollow spindle 1 is provided fixedly pivoted in a spindle rail 29 and driven via a wharve 31 and a tangential belt 30. Extending through the spindle 1 along its entire length is a shaft 32 whose lower extremity is pivoted in a cap rail 33 and whose upper extremity is pivoted on the upper end of the spindle 1. To the shaft 32, the cap 10 is connected in a rotation-fixed manner. The cap 10 consists of a shank 8 and foot 9 and is surrounded by a jacket 35 which extends beyond the upper end of the cap 10 and is provided at its top end with a lid 36. At a central area, the lid 36 is provided with a thread guide eyelet 37 arranged in the axis of rotation of the cap 10. As described in connection with the first embodiment, the jacket 35 is arranged at a distance to the cap 10 so as to allow a thread 21 to coil around the outer wall of the shank 8 and a conical foot 9.

A further jacket 23 is provided extending from a central portion of the jacket 35 to the spindle rail 29 in a direction parallel to the spindle 1 so that part of the jacket 35 as well as spool 3, spindle 1 and wharve 31 are surrounded by the jacket 23. The jackets 23, 35 according to the embodiment of FIG. 2 can be opened up in the same manner as described in connection with the embodiment of FIG. 1 e.g. via respective hinges.

The upper end of the cap 10 is designed in such a way so as to prevent the formation of a thread balloon and includes e.g. a so-called spinning crown 34 (as illustrated in FIG. 2) or may be a spinning finger 34' (FIG. 4).

Connected to the shaft 32 at a position below the spindle 1 is a driving and/or braking device 38. The driving unit of the device 38 is constituted by an electromotor while the braking unit is designed as a generator or a magnetic brake. Consequently by means of the device 38, the cap 10 can be driven and/or decelerated via the shaft 32.

The cap rail 33 is movable by conventional means in direction of double arrow 6 for allowing a build-up of the cop winding and is connected to the jacket 35 via a rail 39 so that the jacket 35 is in synchronism with the upward and downward motion of the cap rail 33. Thus, the distance between the spinning crown 34 and the thread eyelet 37 is continuously maintained as the shaft 32 and thus the cap 10 are also axially displaced by the cap rail 33. Instead of adjusting the vertical position of the cap 10 by the cap rail 33, it is certainly also conceivable to provide the cap in a stationary manner with respect to the spindle 1, and to arrange the spindle 1 such that it moves upwardly and downwardly for providing the axial displacement between the cap 10 and the spindle 1 to build-up the cop winding.

Upon rotation of the cap spinning machine, the thread 1 guided through the eyelet 37 is caught by the spinning crowns 34 in a manner known per se and is coiled round the slim shank 8 of the cap 10 without formation of a thread balloon. As already described in connection with the first embodiment, also in this case, the winding angle of the thread 21 around the cap 10 changes in dependence on the extent by which the rotation of the cap 10 lags behind the rotation of the spindle 1 and leads to a stabilization of the correct differential speed between spindle 1 and cap 10 which speed is altered depending on the winding diameter.

I should note that the single drive of the spindle according to FIG. 1 can be combined with the thread guide as illustrated in FIG. 2 for preventing a thread balloon, and vice versa the tangential belt drive of the spindle according to FIG. 2 can be combined with a guide deflector as shown in FIG. 1.

While the invention has been illustrated and described as embodied in a cap spinning machine, I may note that the invention may certainly be applied in other machines like cap twisting machines or the like. It is thus in particular to be understood that whenever it is referred to spinning, this should also include twisting.

I claim:

1. A cap spinning machine, comprising:

a rotating spindle defining an axis;

a spool sleeve connected to said spindle along a portion thereof and being provided to carry a thread winding forming a spool;

a cap extending over said spool and said sleeve and being rotatable about an axis of rotation;

means for rotatably supporting said cap;

guiding means arranged in the axis of rotation of said cap for leading the thread in helical manner around the outer surface of said cap, said cap being brought into the rotational motion by said spindle by means of the thread so that the rotational speed of said cap is entrained in rotation by the thread; and means for axially displacing said cap and said spool relatively to build said spool on said sleeve.

2. A machine as defined in claim 1 wherein said cap is of a thin-walled structure and includes a slim shank and a conical foot connected to the latter, said shank and said foot covering said spool at a distance thereto and having a contour of the spool or sleeve surrounded by said cap.

3. A machine as defined in claim 2 wherein said shank has an upper end, said means for rotatably supporting said cap including a shaft connected to said upper end of said shank in elongation thereof and a bearing supporting said shaft in a rotatable manner.

4. A machine as defined in claim 3 wherein said guiding means includes a thread deflector arranged at said upper end of said shank.

5. A machine as defined in claim 4 wherein said thread deflector is constituted by a channel accommodated within said shaft and extendIng therethrough in direction of said axis, said channel having an entrance opening arranged in said axis of rotation and an outlet opening at said upper end of said shank.

6. A machine as defined in claim 3, further comprising a driving and braking device operatively connected to said shaft.

7. A machine as defined in claim 6 wherein said driving and braking device includes a driving motor having a rotor connected to said shaft.

8. A machine as defined in claim 1, wherein said cap has an upper portion, said guiding means including a thread guide and being simultaneously developed as suppressing means arranged at said upper end of said cap for prevention of the formation of a thread balloon.

9. A machine as defined in claim 8 wherein said suppressing means includes a spinning crown arranged closely below said thread guide.

10. A machine as defined in claim 8 wherein said suppressig means includes a spinning finger arranged closely below said thread guide.

11. A machine as defined in claim 1, and further comprising a first Jacket surrounding said cap at a small distance therefrom to reduce air friction losses.

12. A machine as defined in claim 11, and further comprising a second jacket surrounding at least said spool.

13. A machine as defined in claim 12 wherein said first and second jackets are developed in one piece.

14. A machine as defined in claim 12 wherein each of said first and second jackets is divided in its longitudinal extension to define two halves, and further comprising hinge means for allowing one of said halves to be opened up to provide access.

15. A machine as defined in claim 1, and further comprising driving means for moving upwardly and downwardly at least said portion of said spindle carrying said spool.

16. A machine as defined in claim 15, and further comprising an electromotor for a single drive of said spindle.

17. A machine as defined in claim 16 wherein said driving means simultaneously moves upwardly and downwardly said electromotor and said spindle.

18. A machine as defined in claim 17, and further comprising a jacket surrounding said spool and said electromotor and accommodating a slot extending in direction of said axis, said driving means penetrating through said slot to act on said electromotor for moving said electromotor and said spindle upwardly and downwardly.

* * * * *